United States Patent [19]

Allan

[11] Patent Number: 4,872,242

[45] Date of Patent: Oct. 10, 1989

[54] FLEXIBLE C-SHAPED STRAP-LIKE CONNECTOR

[76] Inventor: Robert M. Allan, 1731 Colgate Cir., La Jolla, Calif. 92037

[21] Appl. No.: 178,909

[22] Filed: Apr. 7, 1988

[51] Int. Cl.[4] ..... B65D 63/00

[52] U.S. Cl. ..... 24/16 PB; 24/20 EE

[58] Field of Search ..... 24/20 EE, 20 TT, 17 R, 24/16 R, 16 PB, 30.5 P, 30.5 W, 20 R, 20 S, 543, 273, 563

[56] References Cited

U.S. PATENT DOCUMENTS

| | | | |
|---|---|---|---|
| 14,762 | 11/1856 | Springer . | |
| 495,775 | 4/1893 | Bonnamy . | |
| 772,412 | 10/1904 | Garrett et al. . | |
| 983,093 | 1/1911 | Svenson | 24/20 EE |
| 1,330,737 | 2/1920 | Coffman . | |
| 1,751,926 | 3/1930 | Kielberg . | |
| 1,912,180 | 5/1933 | Cornell . | |
| 2,249,764 | 7/1941 | Hothersall . | |
| 2,693,875 | 11/1954 | Chaffee | 24/30.5 W |
| 2,841,850 | 7/1958 | Bahorski | 24/573 |
| 3,078,532 | 2/1963 | Bywater . | |
| 3,514,815 | 6/1970 | Evans | 24/16 PB |
| 3,518,727 | 7/1970 | Eberle et al. | 24/16 PB |
| 3,592,428 | 7/1971 | McFarlane | 24/16 PB |
| 3,735,449 | 5/1973 | Rosales | 24/16 PB |
| 4,073,090 | 2/1978 | Lucia . | |
| 4,557,024 | 12/1985 | Roberts et al. . | |
| 4,674,778 | 6/1987 | Ruiz | 24/20 EE |

*Primary Examiner*—Victor N. Sakran

*Attorney, Agent, or Firm*—William W. Haefliger

[57] ABSTRACT

An elongated connector comprises a flexible, lengthwise elongated, strap-like body having generally C-shaped cross-sections in planes crosswise to the length dimension of the body, with body opposite ends configured to yieldably nest; and teeth may be provided to be outstanding from and spaced apart on the body, the teeth configured to mesh into valleys formed by the body when the body is deformed in a loop and opposite C-shaped end portions of the body are nestably interfitted.

25 Claims, 5 Drawing Sheets

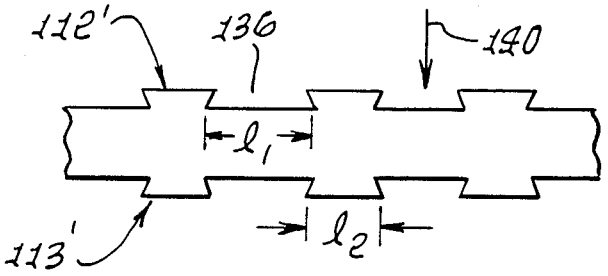
FIG. 4.
FIG. 5.
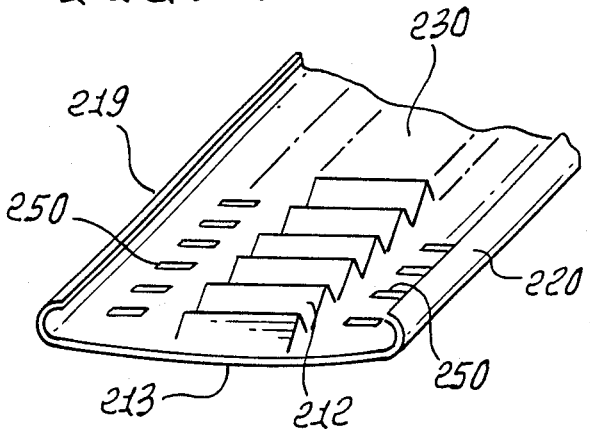
FIG. 6.
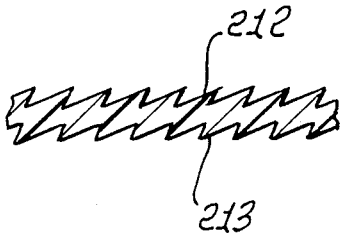
FIG. 8.
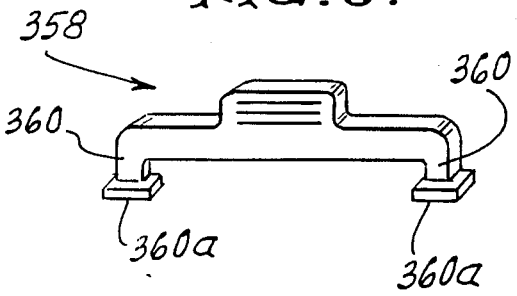
FIG. 7.
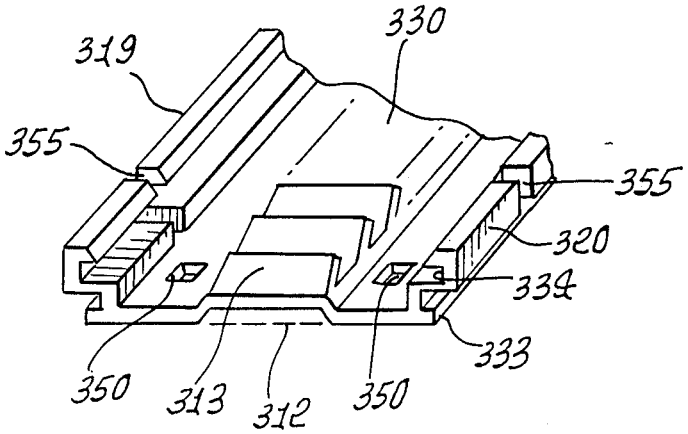
FIG. 9.
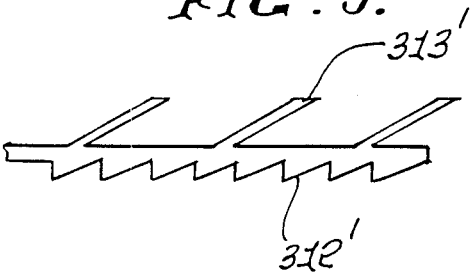

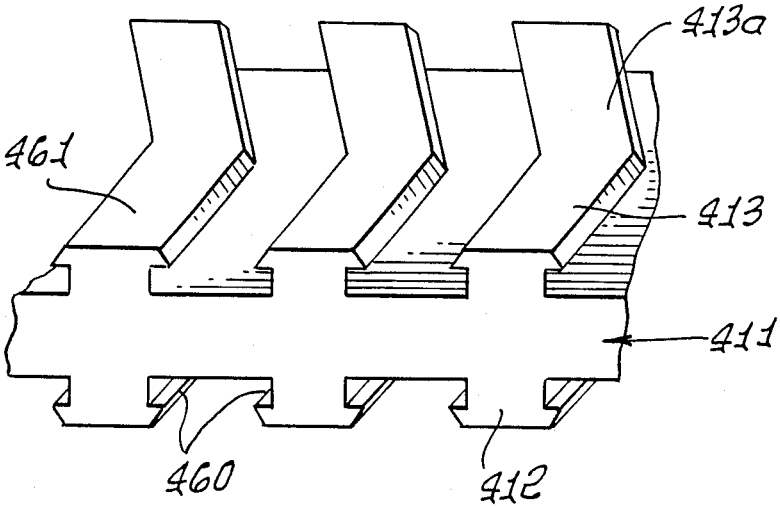
FIG. 10.
FIG. 11.
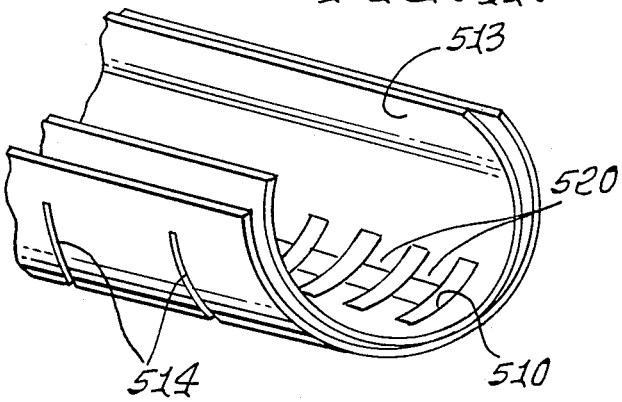
FIG. 12.
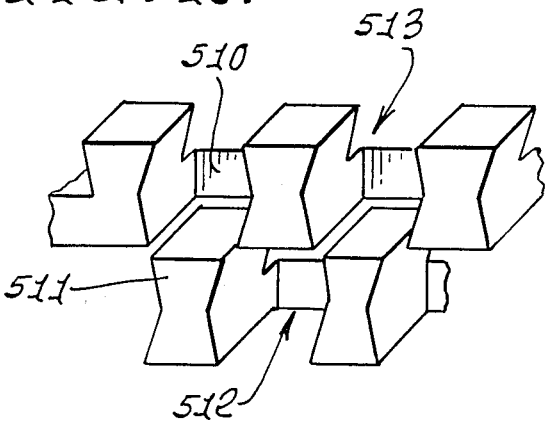
FIG. 12a.
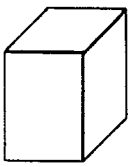
FIG. 13.
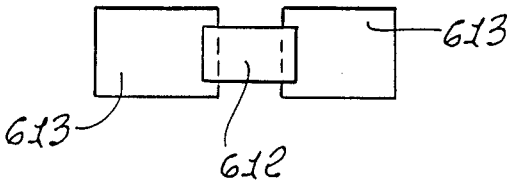

FLEXIBLE C-SHAPED STRAP-LIKE CONNECTOR

BACKGROUND OF THE INVENTION

This invention relates generally to looping connectors and more particularly to strap-type connectors wherein randomly cut lengths which may be connected at any points along their lengths and that positively and firmly hold together under high-tension loading without knots or buckles. Such connectors are, for example, substitutes for and advantageous over strings or cords for tying about articles.

There is need for reliable, easily produced, extruded or molded, strong, monolithic connectors of the type referred to, and which are reusable and adjustable. The connectors described herein meet this need, and are believed to be novel, and highly unusual in their design and construction, as well as in their modes of use.

SUMMARY OF THE INVENTION

It is a major object of the invention to provide connectors meeting the above needs, the basic device of the invention comprising:

(a) a flexible lengthwise elongated, strap-like body having a generally C-shaped cross-section in planes perpendicular to the length dimension of the body, (b) and external and/or internal teeth spaced at right angles to the length dimension of the body, the teeth configured and projecting to mesh together (as into valleys between other teeth) when the body is deformed in a loop and opposite C-shaped end portions of the body are interfitted so that one C-shaped cross-section end portion nests in the other C-shaped cross-section end portion.

The connector typically consists of flexible, synthetic resin such as NYLON or PVC (or other materials) and in one form is characterized in that as one C-shaped end portion is press-fitted into the other, for example, sidewardly, one end portion is compressed and the other expanded, so that the two nest and hold together, laterally, when assembled, thereby aiding engagement of the teeth, and holding the ends of the body together.

It is another object to provide teeth on the connector that have ratchet configuration to permit increased lengthwise relative penetration of the other end portion into the one end portion, and to block endwise relative removal of said other end portion from said one end portion. As will be seen, the teeth may have sawtooth (ramp) configurations, rectangular, vertical configurations, or dovetail cross-sections, in planes lengthwise of the connector. Further, certain teeth may be flexible, i.e., adapted to fold as flaps as the end portions of the connector slide relatively together endwise, in a loop-tightening direction. Also, the connector may have channel shape, with a web interconnecting opposed flanges, and the web that carries the teeth may be perforated to provide attachment means, as for example, stitching. A holder may be fitted into registered perforations on the nested end portions of the connector, to assist in tightening or separating the connected strap end portion.

It is another object to provide a connector in which any section can be connected to any other section without the need of a buckle or similar device.

It is an additional object that each end of a modified connector is specialized, such as, a female end is designed to nest the other male end section into it. An additional object is to provide flanges on the connector to facilitate sewing or otherwise affixing connectors onto end portions of conventional straps or articles of clothing, where connection is desired.

It is yet another object that relatively short sections of a connector can be sewn or affixed to articles such as clothing to hold two pieces together and control movement lengthwise of the connector and/or at right angles to the length of the connector. It is a further object to enable an article of clothing to be tightened or loosened in a manner not possible with buttons, snaps, zippers, etc, by affixing one end of the connector at a selected point along the length of the opposite end of the connector.

These and other objects and advantages of the invention, as well as the details of an illustrative embodiment, will be more fully understood from the following specification and drawings in which:

DRAWING DESCRIPTION

FIG. 1 is a fragmentary perspective view showing one form of the invention;

FIG. 1*a* is an elevation showing the FIG. 1 connector wrapped or bent in a loop for interconnection of its opposite ends;

FIG. 1*b* is an end view, in section showing opposite ends of the FIG. 1 connector in position to be pushed together, for interconnection;

FIG. 1*c* is a view like FIG. 1*b* showing the connector ends after they have been pushed together, and thereby interconnected;

FIG. 1*d* is an enlarged section on lines 1*d*—1*d* of FIG. 1*c;*

FIGS. 3 and 4 are enlarged sections showing two different tooth forms;

FIG. 5 is an enlarged fragmentary perspective view of the end portion of another modified connector;

FIG. 6 is a fragmentary section showing tooth forms as employed in FIG. 5, and lengthwise of the latter;

FIG. 7 is an enlarged fragmentary perspective view of the end portion of yet another modified connector;

FIG. 8 is a perspective view of a holder;

FIG. 9 is a view like FIG. 6, but showing the tooth forms as employed in FIG. 7;

FIG. 10 is a perspective view of yet another modified connector tooth form; and FIGS. 11–23 show modified connectors.

DETAILED DESCRIPTION

Figure 1:
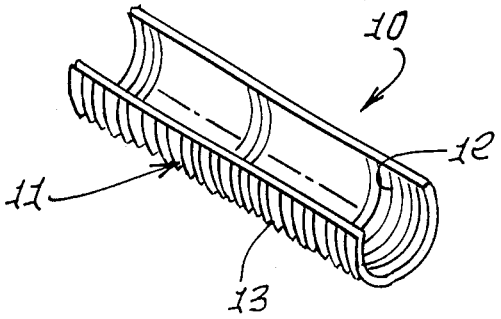
Figure 1B:
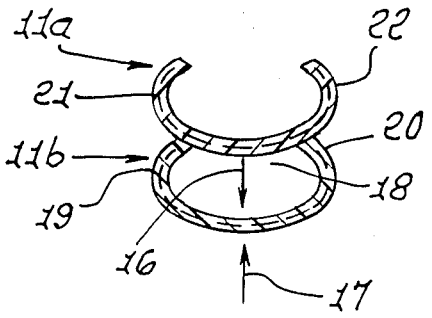
Figure 1A:
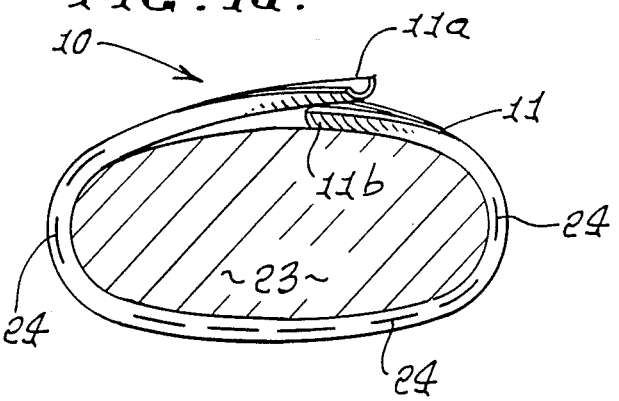
Figure 1C:
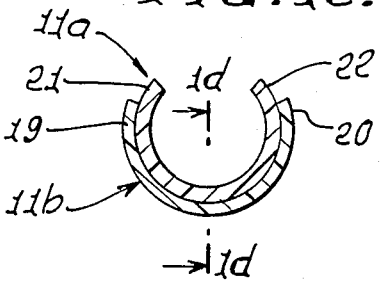

Referring to FIGS. 1 and 1*a*–1*d*, a flexible elongated connector 10 has a body 11 that employs a generally C-shaped cross-section, (for example, at right angles to the length direction of the body), and configured to nest and lock with a second C-shaped cross-section. It may consist of plastic material such as NYLON or PVC, for example. Spaced along the length direction of the body are internal teeth 12, and external teeth 13, formed to mesh (see FIGS. 1*c* and 1*d*) when the body is deformed in a loop (see FIG. 1*a*) to bring opposite end portions 11*a* and 11*b* of the body into closely retained and interfitting relation as shown. For example, FIG. 1*b* shows the end portion 11*a* overlying end portion 11*b*, so that the two end portions can be pushed together, in the direction of arrows 16 and 17. This is accommodated by their C-shapes, in cross-section, end portion 11*a* entering 11b through the gap 18 between the opposite sidewalls 19 and 20 of 11b, to resiliently and yieldably expand those sidewalls away from one another, and to resiliently and yieldably deflect walls 21 and 22 of 11a toward one another, with spring-like interfit, as in FIG. 1c. As a result, the two end portions tend to snap together, and are retained in FIG. 1c assembled position, by their C-shapes, to resist lateral separation. This ensures that the end portions stay nested together, when interfitted as described. The sidewalls 21 and 22 may be relieved or slotted at 24 to facilitate bending of the connector, in a loop.

Also, the described assembly holds together the external teeth 13 and valleys of end portion 11a meshed with internal teeth 12 and valleys of end portion 11b. Such meshing of the teeth and valleys occurs along their lateral extents, which are shown as projecting over substantially the entireties of the C-shaped lateral extents of their cross-sections, both internally and externally, to provide extensive meshing for maximum gripping together of the opposite end portions 11a and 11b. Either end portion fits in and meshes with the other; however, in the drawings, end portion 11a is pushed and nested into end portion 11b, to prevent separation.

Figure 1D:
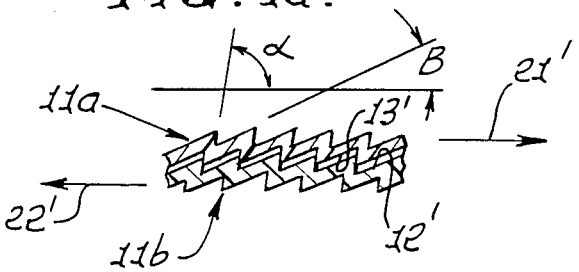

The teeth are angled, as seen in FIG. 1d, to permit ratcheting of the end portions relatively and increasingly together, endwise, as in relative direction 21' for end portion 11a and in relative direction 21' for end portion 11b. This permits tightening of the loop about a workpiece, indicated at 23 in FIG. 1a. Ratchet sliding occurs at interengaged teeth indicated at 13' and 12', in FIG. 1d. Note that the teeth have ratchet ramp shoulders extending at angles $\beta$ relative to the length direction of the connector, and ratchet stop shoulders extending at angles $\alpha$ relative to the length direction of the connector, where $|\alpha| > |\beta|$. The stop shoulders block reverse relative endwise movement of the connector end portions meshed together. To reduce sliding friction, fewer teeth than valleys, or vice versa, or greater spacing thereof, may be employed.

Figure 3:
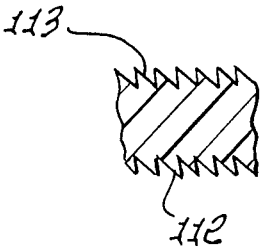
Figure 2:
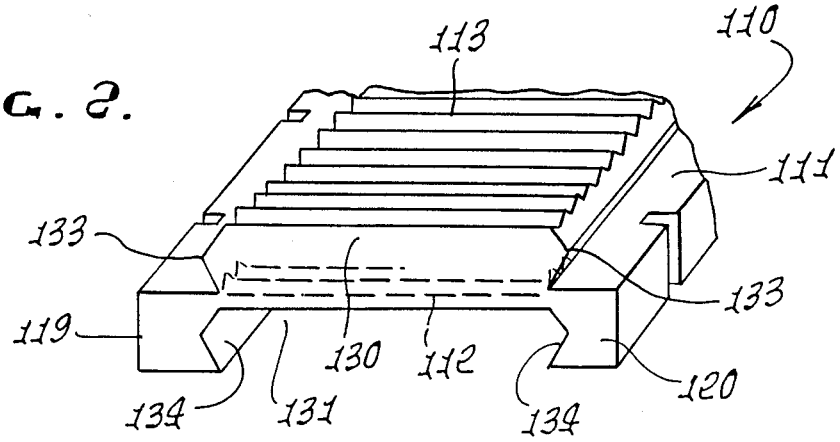
FIG. 2 is an enlarged fragmentary perspective view of the end portion of a modified connector.

In FIG. 2, the modified connector 110 has a body 111 with C-shaped cross-section, wherein the C-shape is a channel having two like and opposed flanges or walls 119 and 120 interconnected by a web 130. External and internal teeth (on the web only, in this design) may have the form and shape as seen at 113 and 112 in FIG. 3. The meshing of such teeth is the same as described above for the FIG. 1 form of the invention, as the opposite ends of the connector 110 are overlapped and pressed together, or slid together relative endwise oppositely. This is facilitated by faced interfitting of web 130 into space 131 between flanges 119 and 120, with shallow V-shaped cross-section tongues 133 on the external lateral sides of the web interfitting (for example slidably) the correspondingly V-shaped grooves 134 on the internal lateral sides of the flanges. The meshing teeth 112 and 113 in FIG. 3 lock together when tension is applied to the strap, but allow tightening of the strap when the interlocked ends are pressed together, laterally. (Such teeth may be flexible to fold down toward the main extent of the web as the ends slide together, but, they unfold or expand to fully mesh together and block relative endwise sliding apart of the end portions of the connector). Flanges 119 and 120 may be relieved or slotted at 121 and 122 to facilitate bending of the connector, in a loop.

In FIG. 4, the alternate external and internal rack-type teeth 113' and 112' are dovetailed or trapezoidal in cross-section; also, the lengths "$l_1$" of the spaces 136 between teeth 112' are greater than the lengths "$l_2$" of the teeth 113', whereby the latter are receivable into such spaces in the normal direction of arrow 140, when the overlying two webs 130 are pressed together. Due to the dovetailing or undercutting of the teeth, they "hook" together to assist in blocking separation of the connected end portions of the connector. Also, the C-shape cross-section of the connector keeps the end portions together when the teeth are not hooked together under tension. FIG. 4 dovetailed teeth may be used for FIGS. 1, 2, 5, and 7-type connectors.

In FIG. 5, the flattened teeth 213 and 212, and valleys, extend in rows along web 230 between arcuate side walls or flanges 219 and 220. The back of the strap has a slight C-shape or bowed shape to allow the strap's two flanges to compress or expand when one end of the strap is assembled to the opposite end. Perforations 250 are formed in two rows along the web, to allow interconnection of the overlying webs of the two end portions of the connector, and strap portions affixed to articles. The teeth are relatively rigid, and angled as in FIG. 6. Flanges 255 are slotted at 255a to permit bending in a loop.

In FIG. 7, the external and internal teeth 313 and 312 also extend in rows along the mid-region of the web 330, and perforations 350 are also provided as in FIG. 5. The teeth 313 are flexible flaps, as in FIG. 9, and that fold as the end portions of the connector slide endwise together in loop-tightening direction, as described in FIG. 2. Note the channel shape of the connector, in cross-section, with side flanges 319 and 320. Internal guide grooves 334 in the flanges slidably receive the external and lateral tongues 333 on the web. The flanges are relieved or slotted at endwise spaced locations 355 to facilitate bending of the connector, in a loop.

In FIG. 9, the modified flexible flap-like teeth 313' and 312', and valleys, are adapted for use on the FIG. 1, 2, 5, or 7 connectors. FIG. 4 trapezoidal teeth may be employed, with straps as in FIGS. 1, 2, 5, and 7. FIG. 8 shows a holder 358 with legs 360 that fit in and lock in registered perforations 250 in FIG. 5, and 350 in FIG. 7. Such perforations may be used as sewing holes on portions of the straps, holding them to other articles, the legs 360 having enlarged tips at 360a to block their removal, once inserted through registered perforations in the nested end portions of the connector.

In FIG. 10, the external and internal teeth 413 and 412 on body 411 have trapezoidal cross-section shapes, as in FIG. 4, but define overhangs over grooves 460. External tooth trapezoids 461 fit into grooves 460 formed by the internal teeth 412, as the end portions of the connector interfit together. Also, the teeth 413 extend laterally, with chevron configuration at 413a, to block lateral sliding of the end portions of the connector. In FIG. 10, the series of C-shaped cross-sections (used to hold the strap teeth and valleys together) are incorporated into valleys between the teeth perpendicular to the longitudinal length of the connector.

All described connectors or straps typically consist of flexible plastic (synthetic resin) material; such as Nylon, for example.

FIG. 11 is an enlarged fragmentary perspective view of the end portion of a modified connector nested with its opposite end. The exterior of the connector is smooth, broken only by its open side, and openings in the body 510 spaced to mesh with the teeth which occurs only on the inside of the body. The teeth are not shown in the perspective; however, their base 520 is shown. The sidewalls may be relieved or slotted at 514 to facilitate bending of the connector, in a loop.

FIG. 12 shows enlarged rack-type teeth 511 of an exterior connector 512 aligned to mesh with the openings 510 in the body of a nested connector 513, and with the connectors shown as at FIG. 11. FIG. 12*a* shows an alternate rectangular block tooth.

FIG. 13 shows enlarged plan view rack-type teeth 612 of FIG. 12 type, and openings in the body of the connector 613.

Figure 14:
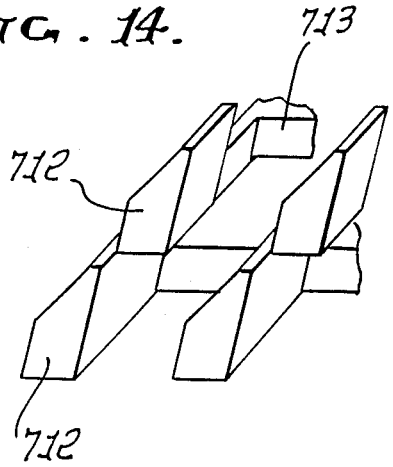

FIG. 14 shows enlarged ratchet-type teeth 712 as an alternate to the dovetail rack teeth of FIG. 12.

Figure 14A:
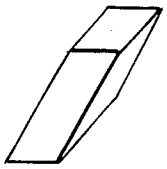

FIG. 14*a* shows alternate ratchet-type tooth.

Figure 15:
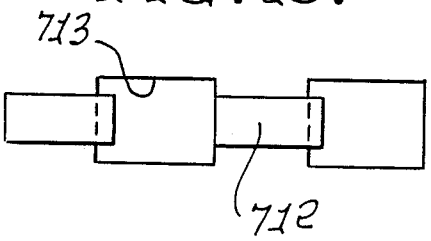

FIG. 15 shows plan view ratchet teeth 712, as shown in FIG. 14, with openings 713.

Figure 16:
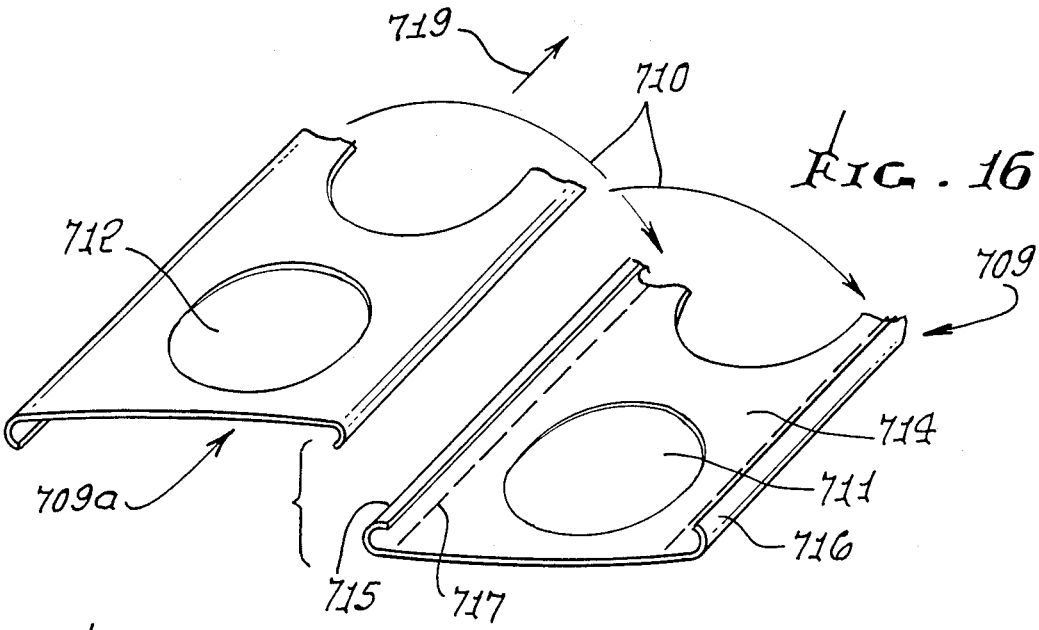

FIG. 16 shows a modified FIG. 1-type connector 709 wherein the open sides of the connector are intended to face prior to nesting indicated by arrows 710. The openings 711 in the top and bottom portions of the connector provide increased flexibility relative to the body 714, and ease of spread of curved flanges 715 and 716. The flanges may also be spread by sewing (at 717) the body 714 of the connector to a garment, shoe, etc. To assist nesting indicated at 710, the opening 712 in the top connector 709*a* provides a finger grip and tightening by sliding top connector 709*a* in direction 719. If desired, ratchet-type teeth are used as in FIG. 6. Also, if desired, the flanges may be slotted as shown in FIG. 5, to increase flexibility of the strap.

Figure 17A:
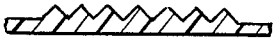
Figure 17B:
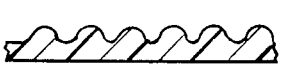
Figure 17:
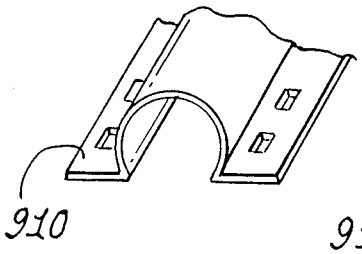
Figure 18:
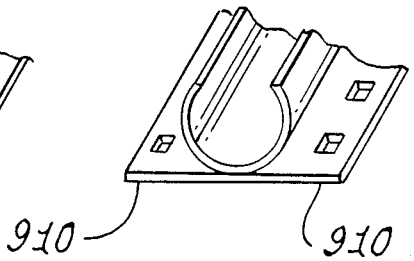

FIGS. 17 and 18 show connectors with flanges 910. These connectors may be nested with other connectors without flanges, or with one flange, as in FIG. 1 or 19. Teeth as in FIGS. 4, 6, 9, 12, and 14 may be used. If the connector is being used to connect, for instance, articles of clothing, together where most strain will be at right angles to the lengthwise direction of the connector, teeth as shown in FIGS. 17*a* and 17*b* may be employed, to allow sliding lengthwise adjustment.

Figure 19:
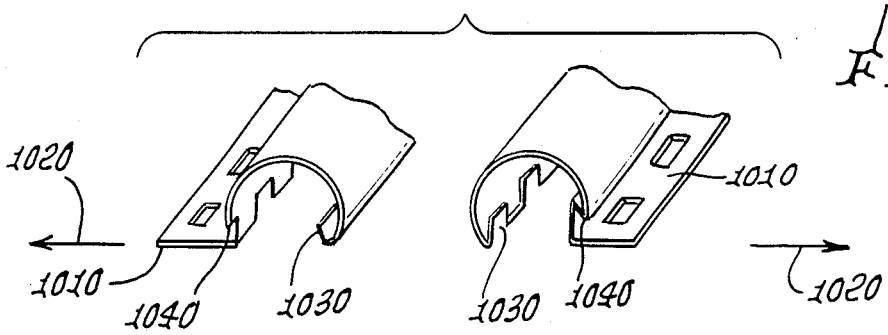

FIG. 19 shows two connectors with flanges 1010 to allow connection of flanges to material, thus providing a method of connecting the material together, horizontally 1020 to the lengthwise direction of the connectors. A small inwardly bent flange with teeth 1030 may be added, and which interconnects with the groove with perforations for teeth 1040 to assist in the nesting of the connector. Short sections of this style connector may be used instead of buttons, snaps, or other varieties of connectors. Longer sections can be used, instead of zippers, for certain applications.

Figure 21:
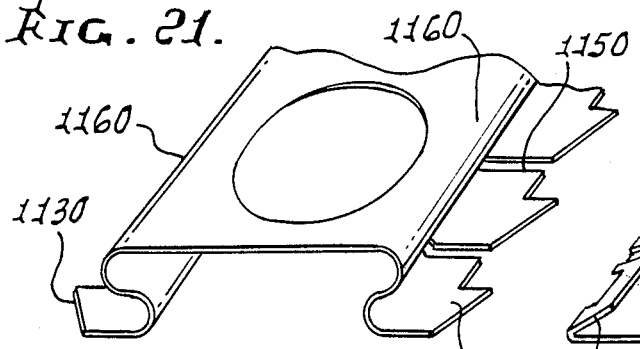
Figure 20:
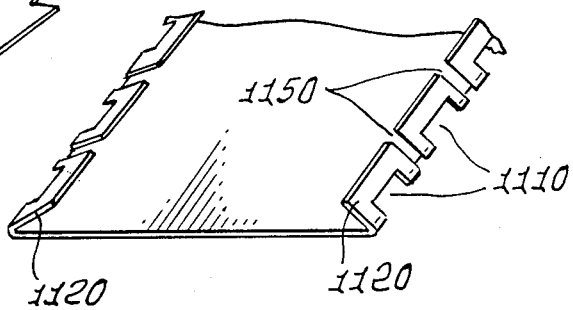

FIG. 20 shows a connector designed to nest the connector of FIG. 21. The connector has notches 1110 in the flanges 1120 designed to receive the ratchet teeth 1130 of the connector FIG. 21. The connector of FIG. 20 has cuts 1150 to aid flexibility. Connector FIG. 21 can be pinched at its shoulders 1160 to flex the connector laterally in order to retract ratchets 1130, for ease of installing the FIG. 21 connector to the FIG. 20 connector, or adjustment.

Figure 23:
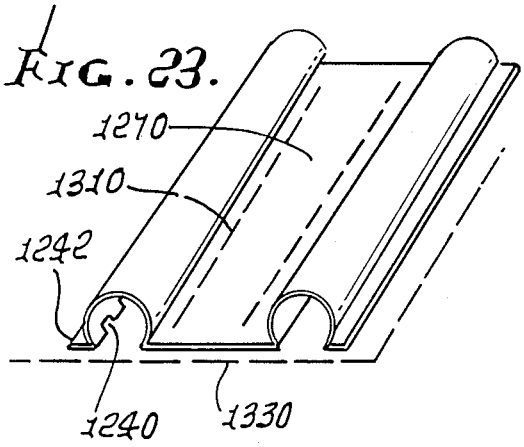
Figure 22:
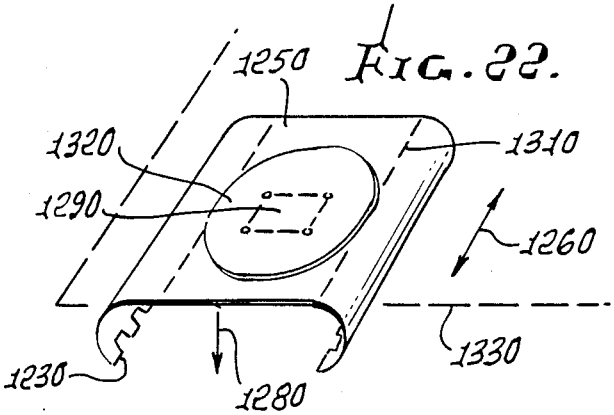

FIG. 22 shows a connector designed to nest over the connector of FIG. 23. This two-part connector may be used in long sections as a strap, or in short sections as button or snap substitutes on (for instance) articles of clothing. The connector has notches 1240 on flanges 1242 (see FIG. 23) designed to receive the rectangular teeth 1230 seen in FIG. 22. The body 1250 of the connector of FIG. 22 may be adjusted (see arrows 1260) on the body 1270 of connector of FIG. 23 by arching downward at 1280 the body 1250, as by pressing the back of the body 1250 in the middle 1290. Fabric 1300 is shown sewn at 1310 to the bodies 1250 and 1270. If desired, one body 1270 may be longer than the other body 1250 to allow for tightening or loosening as at 1260.

A decorative button 1320 is shown sewn on the body 1250 with the fabric 1300 sandwiched in between. The button 1320 provides an easily located point to press the otherwise hidden (by fabric) connector. The body 1250 of one connector may be removed from the body 1220 of the other connector by pressing in direction 1280 with (for instance) the thumb, and pulling up the edge of the fabric 1330. If desired, the ratchet-type teeth such as shown at FIG. 21, 1130 or friction-type teeth as shown at 17*a* and 17*b* can be used.

Figure 24:
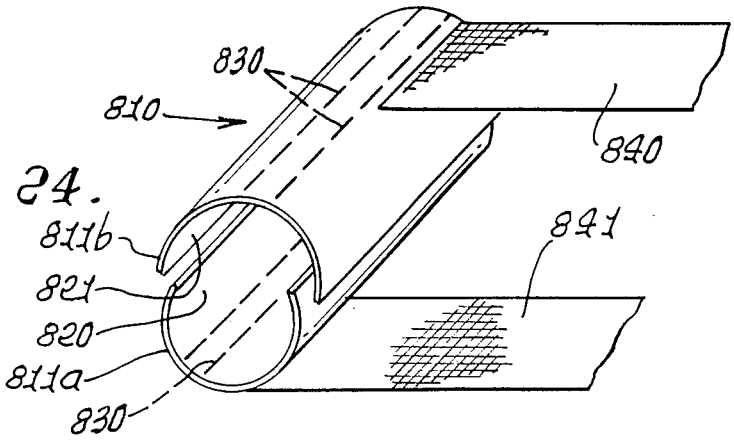
FIG. 24 shows a further modification.

In FIG. 24, the connector 810 is like that of FIG. 1, but with one end 811*a* inverted relative to end 811*b*, with end 811*a* receivable by press-fit into end 811*b*. Note the side opening 820 of 811*a* is smaller than the side opening 821 of 811*b*. Each end can be sewn to fabric, as along stitch lines 830 on its base. See fabric pieces 840 and 841. Teeth are not shown, but are both external and internal, as in FIG. 1

I claim:

1. An elongated connector comprising:

(a) a flexible, lengthwise elongated, strap-like body consisting of synthetic resin and having generally C-shaped cross-section in planes crosswise of and normal to the length dimension of the body, (b) the body having opposite C-shaped end portions which are interfitted so that one C-shaped cross-section end portion nests in and is gripped by the other C-shaped cross-section end portion each C-shaped cross section end portion having opposite walls that terminate at free edges, the walls of said one end portion yieldably deflected toward one another and gripped by the walls of said other end portion which are yieldably expanded away from one another.

2. The connector of claim 1 wherein there are teeth outstanding from and spaced apart on the body, said teeth configured to mesh into valleys formed by the body when the body is deformed in a loop and said one end portion nests in and is gripped by said other end portion.

3. The connector of claim 2 wherein the teeth have ratchet configuration to permit increased lengthwise relative penetration of said other end portion into said one end portion, and to block endwise relative removal of said other end portion from said one end portion.

4. The connector of claim 3 wherein said teeth are external and internal on the body, and have sawtooth configuration.

5. The connector of claim 2 wherein said teeth have dovetail, cross-sections in planes lengthwise of the connector.

6. The connector of claim 5 wherein the dovetail teeth have widths less than the spacings between dovetail teeth, said spacings adapted to receive said dovetail teeth, said rows respectively located at the opposite sides of the connector.

7. The connector of claim 6 wherein said spacings are openings sunk into the connector.

8. The combination of claim 2 wherein certain teeth in one row are angled forwardly, and other teeth in another row are angled reversely, relative to the lengths of the connector, said rows respectively located at the interior and exterior sides of the connector.

9. The connector of claim 2 wherein teeth in rows on one side of the connector are flexible flaps, and teeth on the other side of the connector are relatively rigidly mounted on the connector, said rows respectively located at the interior and exterior sides of the connector.

10. The connector of claim 2 including perforations through the connector at spaced locations therealong and laterally spaced from rows of said external and internal teeth.

11. The connector of claim 10 including a holder having legs fitting in certain perforations in overlying webs defined by end portions of the connector, and a cross-piece interconnecting said legs.

12. The connector of claim 10 wherein the connector is a flat strap with teeth on one or both surfaces, and wherein the valleys between the teeth are C-shaped, and the teeth having flanges which interlock with the teeth and flanges of the opposite end of the connector when they are press-fitted together.

13. The connector of claim 2 wherein one end thereof defines double C-shaped cross-sections connected by a web, with openings on the outer edges of said C-shaped cross-sections spaced to receive teeth defined in the outer edge of the flattened opposite end cross-section of the connector, the teeth being shallow and shaped to disengage the openings when the end of the connector with teeth is depressed.

14. The connector of claim 13 wherein sections of each end of the connector are affixed to other articles.

15. The connector of claim 2 wherein the body defines slots located to facilitate said deforming of the body, as by bending, in a loop.

16. The connector of claim 1 wherein said generally C-shaped configuration is a channel having two spaced walls interconnected by a web, said walls tapering toward one another proximate said free edges thereof.

17. The connector of claim 16 wherein the web and flanges have corresponding tongue-and-groove surfaces for lateral interfit as the opposite end portions of the body slidably interfitted, lengthwise.

18. The connector of claim 17 wherein the external and internal teeth that mesh together are flexible to fold toward the web during endwise sliding interfitting of the opposite end portions in a loop-diminishing direction, and to expand and block endwise relative sliding of said end portions in a loop-expanding direction.

19. The connector of claim 16 wherein the flanges define slots located to facilitate said deforming of the body in a loop.

20. The combination including the connector of claim 1, and fabric attached thereto.

21. The connector of claim 1 which extends in a loop, the C-shapes of both end portions opening outwardly in the same direction, and nesting.

22. The connector of claim 21 including fabric sheet stitched to the mid-section of said C-shaped end portions.

23. The connector of claim 1 wherein the connector has elongated arcuate wall extent between and interconnecting said opposite walls, and including through openings in said arcuate wall extent and spaced along the length of the connector, to accommodate bending thereof about work.

24. The connector of claim 23 wherein there are teeth outstanding from and spaced apart on the body, said teeth configured to mesh into valleys formed by the body when the body is deformed in a loop and said one end portion nests in and is gripped by said other end portion.

25. The connector of claim 24 wherein said through openings in said arcuate wall extent are in lengthwise alignment with said teeth.

* * * * *